US009614300B2

(12) United States Patent
Nakamura et al.

(10) Patent No.: US 9,614,300 B2
(45) Date of Patent: Apr. 4, 2017

(54) ELECTRICAL CONNECTOR AND MANUFACTURING METHOD THEREOF

(71) Applicants: Yazaki Corporation, Tokyo (JP); Dowa Metaltech Co., Ltd., Tokyo (JP)

(72) Inventors: Masatoshi Nakamura, Shizuoka (JP); Akifumi Onodera, Tokyo (JP); Akira Sugawara, Tokyo (JP); Hiroto Narieda, Chiyoda-ku (JP)

(73) Assignees: YAZAKI CORPORATION, Tokyo (JP); DOWA THERMOTECH CO., LTD., Tokyo (JP)

( * ) Notice: Subject to any disclaimer, the term of this patent is extended or adjusted under 35 U.S.C. 154(b) by 0 days.

(21) Appl. No.: 14/327,073

(22) Filed: Jul. 9, 2014

(65) Prior Publication Data

US 2014/0322991 A1 Oct. 30, 2014

Related U.S. Application Data

(63) Continuation of application No. PCT/JP2013/050420, filed on Jan. 11, 2013.

(30) Foreign Application Priority Data

Jan. 13, 2012 (JP) ..... 2012-005023
Jan. 11, 2013 (JP) ..... 2013-003151

(51) Int. Cl.
*H01R 13/11* (2006.01)
*H01R 13/24* (2006.01)
(Continued)

(52) U.S. Cl.
CPC ..... *H01R 4/48* (2013.01); *H01R 13/20* (2013.01); *H01R 13/2464* (2013.01);
(Continued)

(58) Field of Classification Search
CPC H01R 13/2464; H01R 13/2492; H01R 13/11; H01R 13/111; H01R 13/113; H01R 13/114; H01R 13/115
(Continued)

(56) References Cited

U.S. PATENT DOCUMENTS 5,632,631 A * 5/1997 Fjelstad et al. ..... 439/82
6,217,395 B1 * 4/2001 Flieger et al. ..... 439/857
(Continued)

FOREIGN PATENT DOCUMENTS

JP H10-32063 A 2/1998
JP 2001-266990 A 9/2001
(Continued)

OTHER PUBLICATIONS

International Search Report issued in Application No. PCT/JP2013/050420, Mailed Mar. 5, 2013.
(Continued)

*Primary Examiner* — Renee Luebke
*Assistant Examiner* — Paul Baillargeon
(74) *Attorney, Agent, or Firm* — Michael Best & Friedrich LLP

(57) ABSTRACT

An electrical connector connecting a male connector and a female connector in a freely engageable and detachable manner, in which: a male tab is provided at the male connector; a housing part where the male tab is inserted is provided at the female connector; a spring state contact piece and a beat piece to sandwich the male tab are provided at the housing part; and a protrusion protruding toward the male tab inserted into the housing part is provided at least one of the contact piece and the beat piece, wherein the protrusion includes a contact part which is in contact with the male tab inserted into the housing part and a sidewall
(Continued)

part which is provided at a periphery of the contact part, and the contact part has so-called a star-shape in a plan view.

19 Claims, 7 Drawing Sheets

(51) Int. Cl.

| | |
|---|---|
| ***H01R 4/48*** | (2006.01) |
| ***H01R 13/20*** | (2006.01) |
| ***H01R 43/16*** | (2006.01) |
| *H01R 13/05* | (2006.01) |

(52) U.S. Cl.
CPC ..... *H01R 43/16* (2013.01); *H01R 13/05* (2013.01); *H01R 13/11* (2013.01); *H01R 13/113* (2013.01); *H01R 13/114* (2013.01); *Y10T 29/49204* (2015.01); *Y10T 29/49224* (2015.01)

(58) Field of Classification Search
USPC ..... 439/862
See application file for complete search history.

(56) References Cited

U.S. PATENT DOCUMENTS

| | | | | |
|---|---|---|---|---|
| 7,309,251 | B2 * | 12/2007 | Narita | 439/387 |
| 2006/0205290 | A1 | 9/2006 | Narita | |

FOREIGN PATENT DOCUMENTS

| | | | |
|---|---|---|---|
| JP | 2005-141993 | A | 6/2005 |
| JP | 2006-080004 | A | 3/2006 |
| JP | 2006-134681 | A | 5/2006 |
| JP | 2006-228669 | A | 8/2006 |
| JP | 2010-037629 | A | 2/2010 |
| JP | 2010-267584 | A | 11/2010 |

OTHER PUBLICATIONS

Office Action issued in Japanese Application No. 2013-003151, dated Jul. 5, 2016.

* cited by examiner

ELECTRICAL CONNECTOR AND MANUFACTURING METHOD THEREOF

TECHNICAL FIELD

The present invention relates to an electrical connector to easily and surely perform an electrical connection and disconnection, and a manufacturing method thereof. This application is based upon and claims the benefit of priority of the prior Japanese Patent Application No. 2012-5023, filed on Jan. 13, 2012, and Japanese Patent Application No. 2013-3151, filed on Jan. 11, 2013, the entire contents of which are incorporated herein by reference.

BACKGROUND ART

For example, an electrical connector connecting a female connector and a male connector in a freely engageable and detachable manner is used for an electrical connection of a vehicle, an electronic equipment, and so on. When the electrical connector is connected and disconnected, a male tab at the male connector side inserted into the female connector and a contact piece in a spring state which is electrically connected to the male tab at the female connector side slide with each other, and wear debris are generated.

In general, Sn plating is performed for the male tab at the male connector side and the contact piece at the female connector side, and therefore, Sn wear debris are generated by the sliding between the contact piece at the female connector side and the male tab at the male connector side. Electrical resistance of the Sn wear debris becomes high when it is oxidized, and therefore, there is a worry in which contact resistance of the electrical connector becomes high by the wear debris.

In Patent Document 1, a technology in which a thin Ag—Sn alloy layer is further formed on the Sn plating to thereby improve minute slide wear resistance is disclosed. Besides, in Patent Document 2, a technology in which a polygonal projection is provided at the contact piece at the female connector side to thereby remove the wear debris generated at the sliding time to suppress resistance increase at a contact surface is disclosed. In Patent Document 3, a technology in which plural grooves are provided at a contact part to enable a multiple contact to secure a stable contact is disclosed. In Patent Document 4, a technology in which a slide distance is suppressed to be a distance smaller than a slide trace to thereby secure a gas-tight surface which is not exposed to atmosphere is disclosed. Further, in Patent Documents 5, 6, a technology in which a contact part is made difficult to move by a structure of a terminal to thereby prevent the sliding is disclosed.

PRIOR ART DOCUMENT

Patent Document

Patent Document 1: Japanese Laid-open Patent Publication No. 2010-37629

Patent Document 2: Japanese Laid-open Patent Publication No. 2010-267584

Patent Document 3: Japanese Laid-open Patent Publication No. 2001-266990

Patent Document 4: Japanese Laid-open Patent Publication No. 2005-141993

Patent Document 5: Japanese Laid-open Patent Publication No. 2006-134681

Patent Document 6: Japanese Laid-open Patent Publication No. 2006-80004

DISCLOSURE OF THE INVENTION

Problems to Be Solved by the Invention

Incidentally, in recent years, the number of terminals (the number of pins) of the electrical connector tends to increase, and small-sizing of the terminal is required in accordance with the increase in the number of terminals. However, in a small-sized terminal, sheet thicknesses of materials used for the male tab at the male connector side and the contact piece at the female connector side become thin, and therefore, a spring force becomes small, further, it is impossible to keep an enough spring displacement amount, and therefore, a contact load between both becomes small. In case of the Sn plating which is widely used to guarantee electrical reliability at a terminal contact point, it is known that the electrical reliability is damaged by minute slide wear caused by minute sliding if the contact load is small.

Cost increase is incurred when an expensive noble metal plating such as Au, Ag is used, and the contact load is enlarged by using a high-strength material as measures for a problem as stated above. Besides, a measure to enable a standstill contact point by devising a terminal shape can be cited, but the contact point is easy to move when the contact load is small, and it is difficult to suppress the minute slide wear because the slide wear is generated by the sliding in a minute distance. In addition, the wear debris generated by the sliding is easy to enter between the male tab and the contact piece in a conventional terminal structure, and there is a worry in which the contact resistance increases caused by the wear debris.

An object of the present invention is to provide an electrical connector in which the slide wear is reduced as much as possible even in case when the contact load is small, and the wear debris generated by the sliding is difficult to enter between the male tab and the contact piece, and a manufacturing method thereof.

Means for Solving the Problems

To solve the above-stated problems, according to the present invention, an electrical connector connecting a female connector and a male connector in a freely engageable and detachable manner, including: a male tab provided at the male connector; a housing part where the male tab is inserted provided at the female connector; a spring state contact piece and a beat piece to sandwich the male tab provided at the housing part; and a protrusion protruding toward the male tab inserted into the housing part provided at least one of the contact piece and the beat piece, wherein the protrusion includes a contact part which is in contact with the male tab inserted into the housing part and a sidewall part which is provided at a periphery of the contact part, the contact part includes a reverse direction side top part protruding in reverse to a travel direction of the male tab when it is inserted into the housing part, and a pair of cross side top parts protruding in a direction crossing with the travel direction of the male tab in a plan view, and a peripheral edge shape of the contact part is concave toward a center side of the contact part from a line connecting between the reverse direction side top part and the cross side top part, is provided.

In the electrical connector, the contact part further includes a travel direction side top part protruding in the same direction as the travel direction of the male tab when it is inserted into the housing part in the plan view, and the peripheral edge shape of the contact part may be concave toward the center side of the contact part from a line connecting the travel direction side top part and the cross side top part between the travel direction side top part and the cross side top part. The peripheral edge shape of the contact part may be a combination of plural lines. The peripheral edge shape of the contact part may be a curve. Besides, the peripheral edge shape of the contact part may be a combination of a curve and a line. Further, a contact between the male tab and the contact part may be any one of a surface contact, a line contact, and a point contact. An angle of the reverse direction side top part and an angle of the cross side top part may be both 30° or less in the plan view. Besides, an angle of the travel direction side top part may be 30° or less in the plan view.

According to the present invention, a manufacturing method of these electrical connectors, including: forming the protrusion by the press work using a metal mold or the plating is provided. Besides, the protrusion may be formed by the plating.

Effect of the Invention

According to the present invention, a contact part of a protrusion provided at a contact piece and a beat piece is made into so-called a star-shape in a plan view, and thereby, it is possible to avoid wear debris from entering between the contact part and the male tab. Besides, even when a contact area between the contact part and the male tab becomes small, there is a pair of cross side top parts protruding in a direction crossing with a travel direction of the male tab, and therefore, these cross side top parts become resistance at a sliding time, and it is possible to suppress a slide distance. Accordingly, it is possible to reduce the slide wear as much as possible even when a contact load is small. Note that the so-called star protrusion can be formed easily by, for example, the press work using a metal mold and the plating.

MODE FOR CARRYING OUT THE INVENTION

Figure 1:
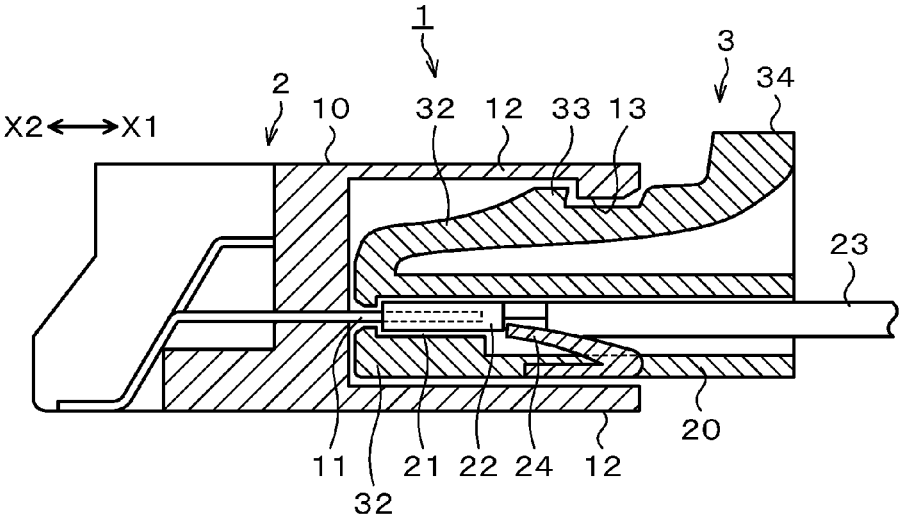
FIG. 1 is a sectional view of an electrical connector according to an embodiment of the present invention.

Hereinafter, an example of an embodiment of the present invention is described with reference to the drawings. Note that in the description and the drawings, the same reference numerals and symbols are used to designate the same components having substantially the same functional configuration, and the redundant description thereof will not be given. As illustrated in FIG. 1, an electrical connector 1 according to the present embodiment includes a male connector 2 and a female connector 3 which are connectable in a freely engageable and detachable manner with each other.

At the male connector 2 illustrated at a left side in FIG. 1, a male tab 11 made up of a conductive material as a male terminal protrudes at a tip surface of a male side resin molding part 10. A cylindrical male side cover 12 disposed to surround a periphery of the male tab 11 is provided at the male side resin molding part 10. A male side engaging lock 13 is provided toward inside at an inner peripheral surface of the male side cover 12.

On the other hand, at the female connector 3 illustrated at a right side in FIG. 1, a box type housing part (cavity) 21 where the male tab 11 is inserted is provided inside a female side resin molding part 20. A female terminal 22 made up of a conductive material is inserted into the housing part 21 from a rear surface side (a right surface side in FIG. 1) of the female side resin molding part (cavity) 20. An electric wire 23 is electrically connected to a rear end (right end in FIG. 1) of the female terminal 22. The female terminal 22 inserted into the housing part 21 is pressed by an elastic lance 24 so as not to fall off.

Figure 2:
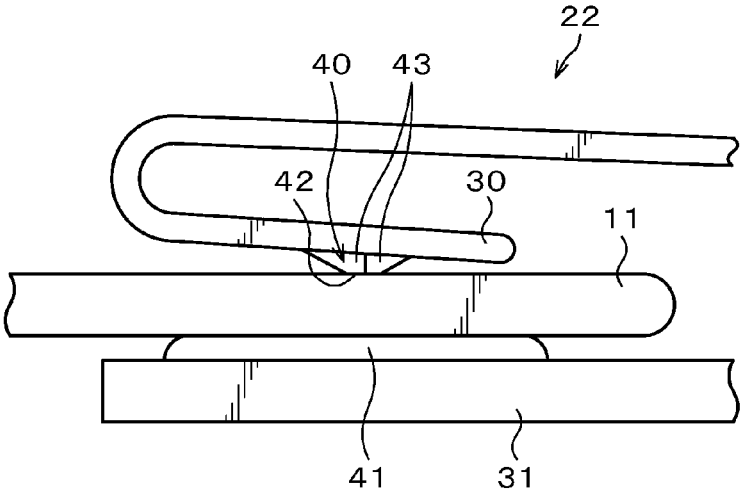
FIG. 2 is an enlarged view of a substantial part of the electrical connector under a state in which a male tab is inserted into a housing part.

As illustrated in FIG. 2, a spring state contact piece 30 and a beat piece 31 are held inside the female terminal 22. The contact piece 30 is made up so that a whole part has elasticity by folding back a metal plate. These contact piece 30 and beat piece 31 are disposed to face with each other with a predetermined distance. As illustrated in FIG. 1 the male tab 11 is inserted into the female terminal 22, and thereby, the male tab 11 is inserted between the contact piece 30 and the beat piece 31 in the housing part 21. As a result, the male tab 11 is sandwiched between these contact piece 30 and beat piece 31 by the elasticity of the contact piece 30, and the male terminal (male tab 11) of the male connector 2 and the female terminal 22 of the female connector 3 become an electrically connected state.

Note that in FIG. 1, a direction moving the male connector 2 in a right direction relative to the female connector 3 is a travel direction X1 of the male tab 11 (the travel direction X1 of the male tab 11 when it is inserted into the housing part 21). Besides, a direction moving the male connector 2 in a left direction relative to the female connector 3 is a reverse direction X2 (the direction X2 pulling out the male tab 11 from the housing part 21) which is in reverse to the travel direction X1 of the male tab 11.

The housing part 21 is covered with a cylindrical female side cover 32. A female side engaging lock 33 which is supported to be freely elastically deformed relative to the female side resin molding part 20 is provided toward outside at an outer peripheral surface of the female side cover 32. As illustrated in FIG. 1, the male connector 2 is moved in the travel direction X1, the female cover 32 of the female connector 3 is inserted into the male side cover 12 of the male connector 2 to engage the male side engaging lock 13 and the female side engaging lock 33, and thereby, a connection state of the electrical connector 1 is held. Besides, under the connection state of the electrical connector 1, the male tab 11 is inserted into the female terminal 22, enters between the contact piece 30 and the beat piece 31, and the male terminal (male tab 11) of the male connector 2 and the female terminal 22 of the female connector 3 become the electrically connected state, as stated above.

Note that a release protrusion 34 formed at an outer peripheral surface of the female side resin molding part (cavity) 20 is pressed, and thereby, the female side engaging lock 33 is pushed, and it becomes a state in which engagement between the male side engaging lock 13 and the female side engaging lock 33 is disengaged. It is thereby possible to pull out the male connector 2 from the female connector 3, and the electrical connection between the male terminal (male tab 11) of the male connector 2 and the female terminal 22 of the female connector 3 is released.

As illustrated in FIG. 2, a protrusion 40 protruding toward a surface of the male tab 11 inserted into the housing part 21 is provided at a surface of the contact piece 30. Besides, a beat part 41 protruding toward the surface of the male tab 11 inserted into the housing part 21 is provided at a surface of the beat piece 31. These protrusion 40 and beat part 41 are brought into contact with the surface of the male tab 11 inserted into the housing part 21, and the male tab 11 is sandwiched between the protrusion 40 and the beat part 41.

Figure 3:
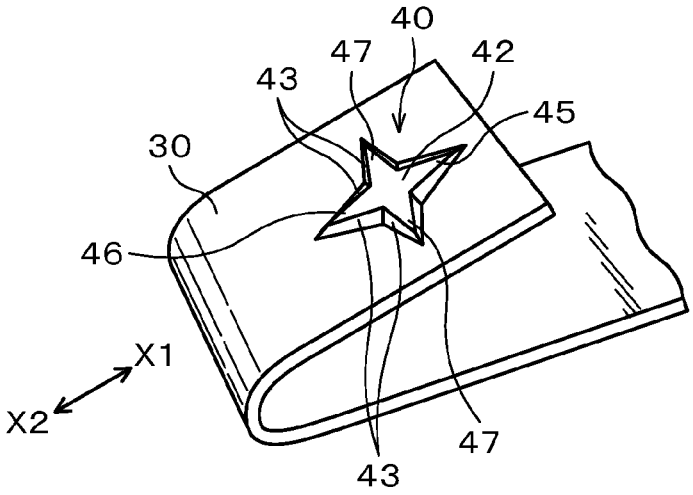
FIG. 3 is a perspective view of a contact piece.
Figure 4:
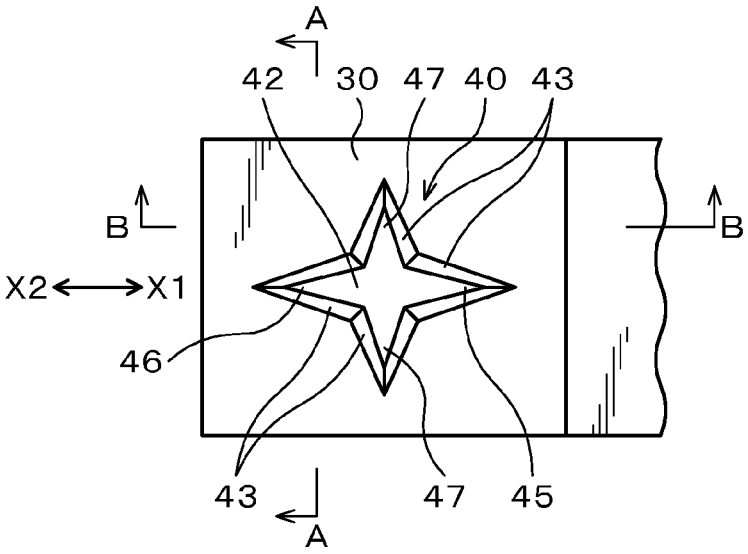
FIG. 4 is a plan view of the contact piece.
Figure 5:
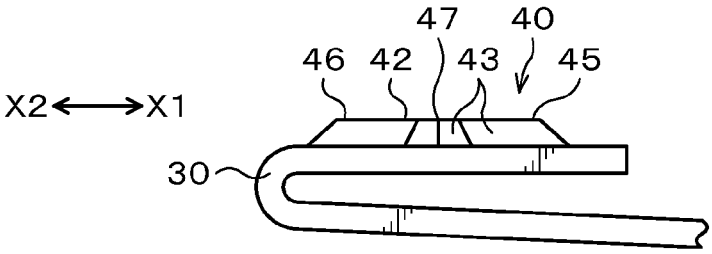
FIG. 5 is a side view of the contact piece.

As illustrated in FIGS. 3 to 5, the protrusion 40 formed at the contact piece 30 includes a contact part 42 which is in contact with the male tab 11 inserted into the housing part 21 and a sidewall part 43 provided at a periphery of the contact part 42. In the present embodiment, a top of the protrusion 40 is the contact part 42 in a plan state, and the contact part 42 is in surface contact with the surface of the male tab 11 inserted into the housing part 21.

Besides, the contact part 42 has so-called a star shape in a plan view, and includes a travel direction side top part 45 protruding in the travel direction X1, a reverse direction side top part 46 protruding in the reverse direction X2, and a pair of cross side top parts 47, 47 each protruding in a direction which crosses in approximately perpendicular to the travel direction X1 (reverse direction X2). Note that "in a plan view" means a state in which a surface of the contact piece 30 is seen from the male tab 11 side inserted into the housing part 21.

Figure 6:
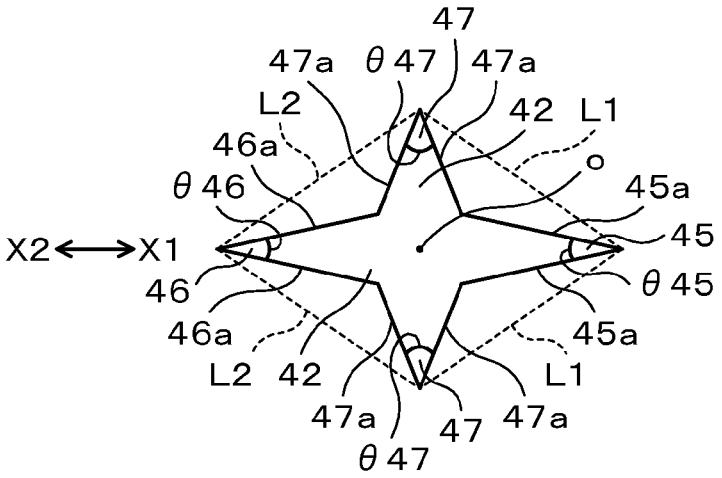
FIG. 6 is a plan view at a contact part, and a peripheral edge shape is a combination of plural lines.

As illustrated in FIG. 6, a peripheral edge shape of the contact part 42 being the top of the protrusion 40 is a concave shape toward a center O side of the contact part 42 from a line L1 connecting the travel direction side top part 45 and the cross side top part 47 between the travel direction side top part 45 and the cross side top part 47. Similarly, it has the concave shape toward the center O side of the contact part 42 from a line L2 connecting the reverse direction side top part 46 and the cross side top part 47 between the reverse direction side top part 46 and the cross side top part 47.

Namely, in the embodiment illustrated in FIG. 6, the travel direction side top part 45 is an acute angle sandwiched by two lines 45*a*, 45*a* in the plan view, and an angle θ45 of the travel direction side top part 45 is smaller than a crossing angle between the lines L1, L1 at the travel direction side top part 45 with each other. Similarly, the reverse direction side top part 46 is an acute angle sandwiched by two lines 46*a*, 46*a* in the plan view, and an angle θ46 of the reverse direction side top part 46 is smaller than a crossing angle between the lines L2, L2 with each other at the reverse direction side top part 46. Besides, the cross side top part 47 is sandwiched by two lines 47*a*, 47*a* in the plan view, and an angle θ47 of the cross side top part 47 at the cross side top part 47 is smaller than a crossing angle between the lines L1, L2 at the cross side top part 47.

Note that to enhance effects of the present invention avoiding that the wear debris enter between the contact part and the male tab and suppressing the slide distance, it is preferable that the angle θ45 of the travel direction side top part 45, the angle θ46 of the reverse direction side top part 46, and the angles θ47 of the cross side top parts 47 are 30° or less.

In the embodiment illustrated in FIG. 6, the contact part 42 has so-called a planar star shape having four top parts of the travel direction side top part 45, the cross side top part 47, the reverse direction side top part 46, and the cross side top part 47 surrounded by respective lines 45*a*, 46*a*, 47*a*.

Figure 7:
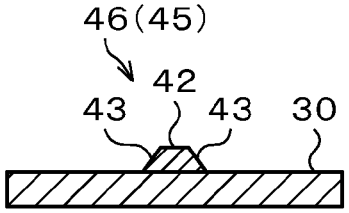
FIG. 7 is an A-A sectional view in FIG. 4.
Figure 8:
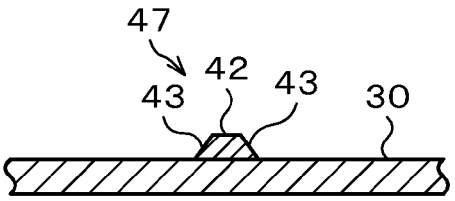
FIG. 8 is a B-B sectional view in FIG. 4.

Besides, in the present embodiment, the sidewall part 43 provided at the periphery of the contact part 42 has an inclined surface widening toward outside as it approaches to the surface of the contact piece 30, and it has approximately a trapezoid cross sectional shape at each of the travel direction side top part 45, the reverse direction side top part 46, the cross side top parts 47 as illustrated in FIGS. 7, 8.

In the electrical connector 1 made up as stated above, the male connector 2 is moved in the travel direction X1 to insert the male tab 11 into the housing part 21 of the female connector 3 to thereby electrically connect the male connector 2 and the female connector 3. The male tab 11 is inserted between the contact piece 30 and the beat piece 31 in the housing part 21, and the male terminal (male tab 11) of the male connector 2 and the female terminal 22 of the female connector 3 become the electrically connected state.

Figure 9:
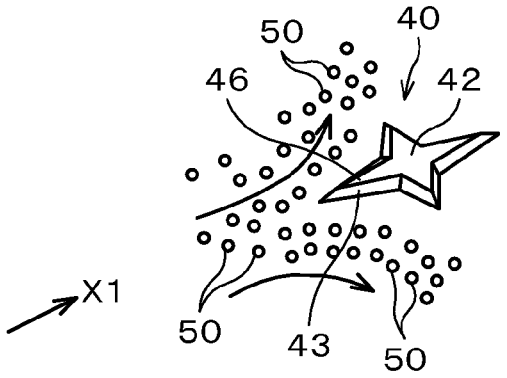
FIG. 9 is a perspective view illustrating a removal action of wear debris when the male tab is inserted.

When the male connector 2 and the female connector 3 are connected as stated above, the contact part 42 being the top of the protrusion 40 formed at the contact piece 30 and the surface of the male tab 11 slide under the surface contact state, and therefore, wear debris 50 are generated between both. However, in the electrical connector 1 according to the embodiment of the present invention, as illustrated in FIG. 9, the contact part 42 is brought into contact with the surface of the male tab 11 headed by the reverse direction side top part 46, and the wear debris 50 are pushed apart toward both sides by the reverse direction side top part 46 when the male connector 2 travels in the travel direction X1 in accordance with the insertion of the male tab 11. The wear debris 50 are thereby difficult to enter between the surface of the male tab 11 and the contact part 42.

In this case, as it is described in FIG. 6, the peripheral edge shape of the contact part 42 is the concave shape toward the center O side between the reverse direction side top part 46 and the cross side top part 47, and the angle θ46 of the reverse direction side top part 46 is sharply pointed, and therefore, the wear debris 50 seldom enter between the surface of the male tab 11 and the contact part 42. Accordingly, the contact part 42 of the protrusion 40 formed at the contact piece 30 is coherently in surface contact with the surface of the male tab 11 inserted between the contact piece 30 and the beat piece 31, the male terminal (male tab 11) of the male connector 2 and the female terminal 22 of the female connector 3 are surely electrically connected, and it is possible to previously prevent troubles such as a voltage reduction caused by high contact resistance, heat generation, and so on.

On the other hand, to release the electrical connection between the male connector 2 and the female connector 3, the male connector 2 is pulled toward the reverse direction X2, and the male connector 2 is pulled out of the female connector 3. The contact part 42 being the top of the protrusion 40 formed at the contact piece 30 similarly slides under the surface contact with the surface of the male tab 11, and therefore, the wear debris 50 are generated between both also in the case when the male connector 2 is pulled out of the female connector 3.

Figure 10:
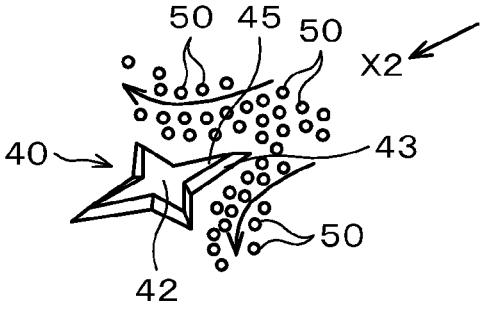
FIG. 10 is a perspective view illustrating the removal action of the wear debris when the male tab is pulled out.

However, in the electrical connector 1 according to the embodiment of the present invention, as illustrated in FIG. 10, the contact part 42 is brought into contact with the surface of the male tab 11 headed by the travel direction side top part 45 when the male connector 2 is pulled out of the female connector 3, and the wear debris 50 are pushed apart toward both sides by the travel direction side top part 45 when the male connector 2 travels in the reverse direction X2 in accordance with the pulling out of the male tab 11. As stated above, the wear debris 50 are difficult to enter between the surface of the male tab 11 and the contact part 42, and adhesion of the wear debris 50 to the contact part 42 is suppressed also in the case when the male connector 2 is pulled out of the female connector 3.

Besides, as it is described in FIG. 6, the peripheral edge shape of the contact part 42 is the concave shape toward the center O side between the travel direction side top part 45 and the cross side top part 47, and the angle θ45 of the travel direction side top part 45 is sharply pointed, and therefore, the wear debris 50 seldom enter between the surface of the male tab 11 and the contact part 42 also in the case when the male connector 2 is pulled out of the female connector 3. Accordingly, the adhesion of the wear debris 50 to the contact part 42 is suppressed also in the case when the male connector 2 is pulled out of the female connector 3.

Figure 11:
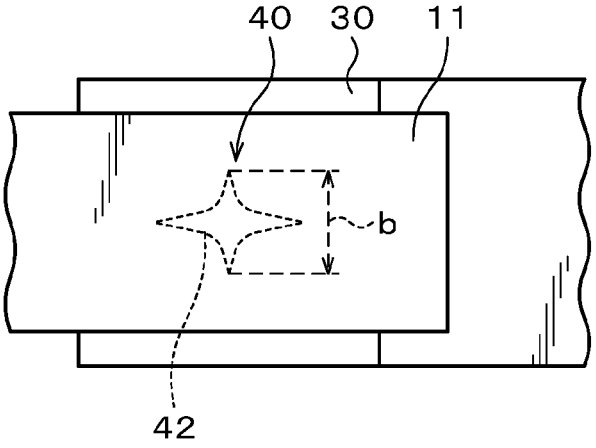
FIG. 11 is a plan view of the male tab and the contact piece representing an engaged state.

Further, as illustrated in FIG. 11, an entire surface of the contact part 42 being the top of the protrusion 40 formed at the contact piece 30 is in surface contact with the surface of the male tab 11 under the state in which the male terminal (male tab 11) of the male connector 2 and the female terminal 22 of the female connector 3 are electrically connected, and a relative moving between both is suppressed to be minimum by tightly sandwiching the male tab 11 between the contact piece 30 and the beat piece 31.

Figure 12:
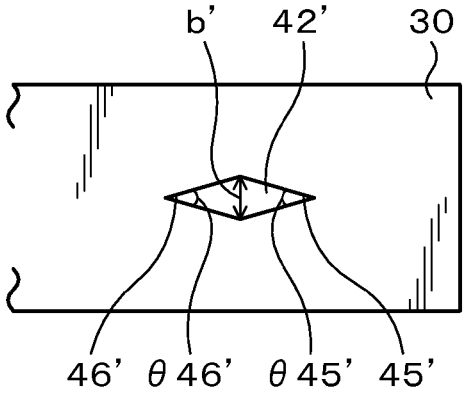
FIG. 12 is an explanatory view of a conventional contact part in a rhombus shape.

Namely, as illustrated in FIG. 12, when, for example, a rhombus contact part 42' whose four sides are surrounded by lines is brought into contact with the surface of the male tab 11, it is desirable to make both an angle θ46' of a reverse direction side top part 46' and an angle θ45' of a travel direction side top part 45' small to avoid the adhesion of the wear debris 50 to the contact part 42' when the male connector 2 and the female connector 3 are connected and when the male connector 2 is pulled out of the female connector 3. However, when the angle θ46' of the reverse direction side top part 46' and the angle θ45' of the travel direction side top part 45' are made small, a width b' of the contact part 42' becomes also small, and a whole area of the contact part 42' drastically decreases. A contact area relative to the surface of the male tab 11 decreases in accordance with the area decrease of the contact part 42', and resistance becomes large. Besides, it becomes difficult to tightly sandwich the male tab 11 between the contact piece 30 and the beat piece 31 caused by the contact area decrease, and the relative moving between both is easy to occur. Further, the wear debris 50 are generated more caused by the relative moving between both.

In the electrical connector 1 according to the embodiment of the present invention, the shape of the contact part 42 being the top of the protrusion 40 formed at the contact piece 30 is so-called the star shape. Accordingly, it is possible to enlarge a width b of the contact part 42 (a distance between the pair of the cross side top parts 47, 47) and to enlarge a surface area of the contact part 42 even if the angle θ46 of the reverse direction side top part 46 and the angle θ45 of the travel direction side top part 45 are made small. As a result, the contact area relative to the surface of the male tab 11 increases, and the resistance becomes small. Besides, it is possible to tightly sandwich the male tab 11 between the contact piece 30 and the beat piece 31, the relative moving between both is difficult to occur, and the generation of the wear debris 50 can be reduced owing to the increase of the contact area. In particular, the cross side top parts 47 extending in a vertical direction relative to the travel direction X1 and the reverse direction X2 of the male tab 11 become the resistances at the sliding time, and it becomes possible to suppress the slide distance.

There are effects in the electrical connector 1 of the present invention in which the adhesion of the wear debris 50 to the contact part 42 is suppressed at insertion and extraction times of a terminal, and a minute slide wear in which slide wear is generated by a sliding with a minute load (for example, a contact load at a contact point is 3 N or less) and in a minute distance. When the contact load is small, the contact point is easy to move, and the slide wear are generated by the sliding in the minute distance. However, in case of the present invention, it is possible to make the width b of the contact part 42 large, and to make the contact area large, and therefore, there is an effect to suppress the minute slide in itself compared to a conventional terminal structure. Besides, the adhesion of the wear debris 50 to the contact part 42 can be suppressed by the travel direction side top part 45 and the reverse direction side top part 46, and the increase of the contact resistance can be suppressed.

Figure 13:
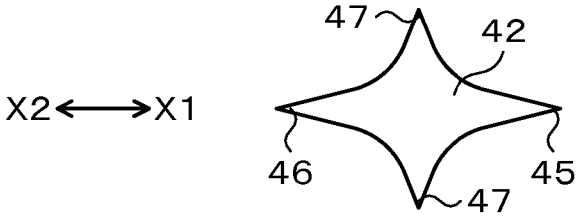
FIG. 13 is a plan view of the contact part, and the peripheral edge shape is a curve.
Figure 14:
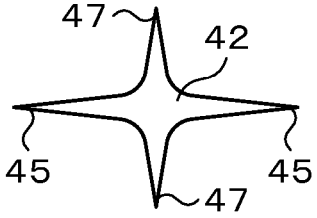
FIG. 14 is a plan view of the contact part, and the peripheral edge shape is a combination of a curve and a line.

Hereinabove, the embodiments of the present invention are exemplified to be described, but the present invention is not limited to the embodiments described here. For example, in the embodiment illustrated in FIG. 6, an example is illustrated as the shape of the contact part 42 to be surrounded by the respective lines 45*a*, 46*a*, 47*a*. However, the peripheral edge shape of the contact part 42 may be one surrounded by curves as illustrated in FIG. 13. Besides, the peripheral edge shape of the contact part 42 may be one surrounded by combinations of each of a curve and a line as illustrated in FIG. 14. As stated above, the peripheral edge shape of the contact part 42 is made to be the curve, and thereby, the contact area of the contact part 42 relative to the surface of the male tab 11 increases, and the resistance becomes further small.

Figure 15:
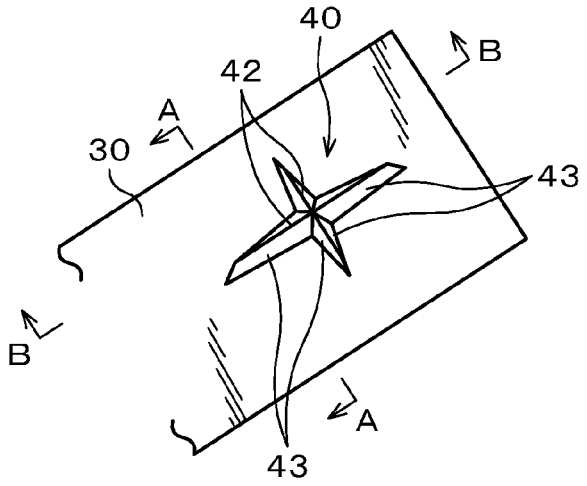
FIG. 15 is a perspective view of a protrusion according to another embodiment of the present invention, and a contact between the male tab and the protrusion is a line contact.
Figure 16:
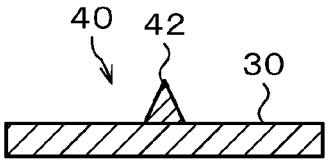
FIG. 16 is an A-A sectional view in FIG. 15.
Figure 17:
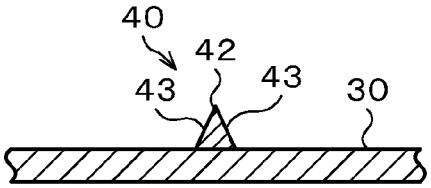
FIG. 17 is a B-B sectional view in FIG. 15.

Besides, the contact of the contact part 42 relative to the surface of the male tab 11 is not limited to the surface contact, but may be the line contact or a point contact. In an embodiment illustrated in FIGS. 15 to 17, the shape of the contact part 42 being the top of the protrusion 40 is a cross-shaped line state. The shape of the contact part 42 is made to be the one illustrated in FIG. 15, and thereby, it become possible to press the contact part 42 relative to the surface of the male tab 11 in the line contact.

Besides, a position forming the protrusion 40 is not limited to the contact piece 30, but the protrusion 40 may be formed at the beat part 41. Besides, the protrusion 40 may be formed at both the contact piece 30 and the beat part 41. Further, the protrusion 40 may be formed at plural positions. The plural protrusions 40 are provided, and thereby, it becomes possible to enable a more reliable terminal structure.

Note that according to the present invention, the entering of the wear debris 50 between the surface of the male tab 11 and the contact part 42 can be suppressed, and therefore, it is possible to perform the Sn plating similar to the conventional one at the surface of the male tab 11, and the surfaces of the contact piece 30 and the beat piece 31, and it is possible to obtain a high reliability electrical connector without using an expensive noble metal plating such as Au, Ag. When the Sn plating is performed, a plating structure in plural layers of only Sn, Ni—Cu—Sn, Ni—Cu—CuSn compound-Sn, CuSn compound-Sn, Ni—Sn, and so on from a surface side of conductive base materials such as the contact piece 30, the beat piece, and the male tab 11 are conceivable as a coating structure. Note that in the present embodiment, it is no problem if the noble metal platings such as Au, Ag are used.

Note that a conductive base material made up of a high-strength and high-cost copper alloy such as Be copper, copper-titanium may be used as the female terminal such as the contact piece 30 and the beat piece 31, but these copper alloys are high-cost, and therefore, a lower cost Cu—Ni—Si based (Corson) alloy, a Cu—Ni—Sn—P based alloy (for example, copper alloys such as NB109, NB105 manufactured by DOWA metaltech Co., Ltd.), phosphor bronze, and so on are usable and preferable. Brass is preferable for the male terminal such as the male tab 11. Besides, as materials of the male terminal or the female terminal, conductive materials made up of an iron-based material such as a stainless steel (SUS) and an aluminum alloy may be used. Besides, a plating process is preferably formed by the electroplating from a cost phase, and the reflow treatment is used according to need.

Besides, the protrusion 40 is able to be formed by, for example, the press work using a metal mold. To form so-called the star-shaped protrusion 40 as in the present invention, a part of a press metal mold of the female terminal may be changed. A timing to perform the press work may be either before or after the plating process. A processing method is not limited to the press work such that, for example, the protrusion is formed by the Sn plating as long as the similar shape can be obtained.

In the electrical connector of the present invention, only the shape of the protrusion 40 of the female terminal is to be changed, and the male terminal may be the conventional one. Note that when the protrusion 40 is formed at the beat part 41, it is possible to easily provide the protrusion 40 at the beat part 41 by the press work different from the spring state contact piece 30.

Besides, in the above-stated embodiments, the example in which the protrusion 40 includes both the travel direction side top part 45 protruding in the travel direction X1 and the reverse direction side top part 46 protruding in the reverse direction X2 is illustrated, but the protrusion 40 is necessary to include only the travel direction side top part 45 protruding in the travel direction X1, the reverse direction side top part 46 protruding in the reverse direction X2, and the cross side top parts 47 from a point of view of preventing that the wear debris 50 enter when the male connector 2 and the female connector 3 are connected, and the travel direction side top part 45 may not be provided.

Figure 18:
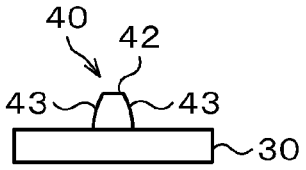
FIG. 18 is an explanatory view of a modification example of a cross-sectional shape of the protrusion.
Figure 19:
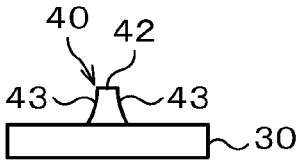
FIG. 19 is an explanatory view of the modification example of the cross-sectional shape of the protrusion.
Figure 20:
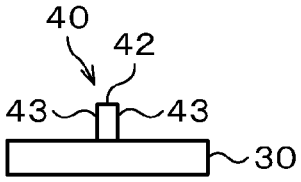
FIG. 20 is an explanatory view of the modification example of the cross-sectional shape of the protrusion.
Figure 21:
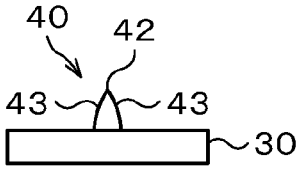
FIG. 21 is an explanatory view of the modification example of the cross-sectional shape of the protrusion.
Figure 22:
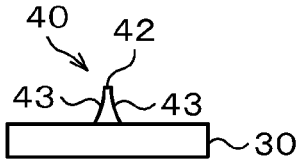
FIG. 22 is an explanatory view of the modification example of the cross-sectional shape of the protrusion.
Figure 23:
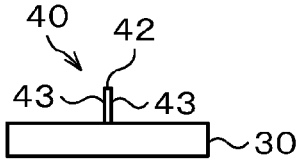
FIG. 23 is an explanatory view of the modification example of the cross-sectional shape of the protrusion.

Further, the example in which the sidewall part 43 provided at the periphery of the contact part 42 is the inclining plane is illustrated in FIGS. 7, 8, but the sidewall part 43 may be a curvature convex toward outside as illustrated in FIG. 18, or the sidewall part 43 may be a curvature convex toward inside as illustrated in FIG. 19. Besides, as illustrated in FIG. 20, the sidewall part 43 may be a vertical plane. Similarly, the example in which the sidewall part 43 provided at the periphery of the contact part 42 is the inclined plane is illustrated in each of FIGS. 16, 17, but the sidewall part 43 may be a curvature convex toward outside as illustrated in FIG. 21, or the sidewall part 43 may be a curvature convex toward inside as illustrated in FIG. 22. Besides, as illustrated in FIG. 23, the sidewall part 43 may be a vertical plane.

EXPLANATION OF CODES

X1 travel direction
X2 reverse direction
1 electrical connector
2 male connector
3 female connector
10 male side resin molding part
11 male tab
12 male side cover
13 male side engaging lock
20 female side resin molding part
21 housing part
22 female terminal
23 electric wire
24 lance
30 contact piece
31 beat piece
32 female side cover
33 female side engaging lock
34 release protrusion
40 protrusion
41 beat part
42 contact part
43 sidewall part
45 travel direction side top part
46 reverse direction side top part
47 cross side top part

What is claimed is:

1. A female connector freely engageable and detachable with a male connector comprising:

a housing part to which a male tab of the male connector is insertable;

a spring state contact piece and a beat piece configured to sandwich the male tab when the male connector is inserted into the housing part; and a protrusion provided at at least one of the contact piece and the beat piece, the protrusion is configured to protrude toward the male tab when the male tab is inserted into the housing part;

wherein the protrusion includes a contact part and a sidewall part, the contact part is configured to be in contact with the male tab when the male connector is inserted into the housing part, and the sidewall part is provided at a periphery of the contact part, the contact part includes a reverse direction side top part protruding in reverse to a travel direction of the male tab when it is inserted into the housing part, the reverse direction side top part having a first pointed tip, and first and second cross side top parts respectively protruding in a direction crossing with the travel direction of the male tab in a plan view, and an internal angle of the first pointed tip is smaller than an angle between a first virtual line connecting the first pointed tip to a tip of the first cross side top part and a second virtual line connecting the first pointed tip to a tip of the second cross side top part.

2. The female connector according to claim 1, wherein the contact part further includes a travel direction side top part protruding in the same direction as the travel direction of the male tab when it is inserted into the housing part in the plan view, the travel direction side top part having a second pointed tip, and an internal angle of the second pointed tip is smaller than an angle between a first virtual line connecting the second pointed tip to a tip of the first cross side top part and a second virtual line connecting the second pointed tip to a tip of the second cross side top part.

3. The female connector according to claim 1, wherein the peripheral edge shape of the contact part is any one of a combination of plural lines, a curve, and a combination of a curve and a line.

4. The female connector according to claim 2, wherein an angle of the travel direction side top part is 30° or less in the plan view.

5. The female connector according to claim 1, wherein a contact between the male tab and the contact part is any one of a surface contact, a line contact, and a point contact.

6. The female connector according to claim 1, wherein the internal angle of the first pointed tip and an internal angle of each of the first and second cross side top parts are each 30° or less in the plan view.

7. An electrical connector connecting a female connector and a male connector in a freely engageable and detachable manner, comprising:

a male tab provided at the male connector;

a housing part where the male tab is inserted provided at the female connector;

a spring state contact piece and a beat piece to sandwich the male tab provided at the housing part; and a protrusion protruding toward the male tab inserted into the housing part provided at at least one of the contact piece and the beat piece, wherein the protrusion includes a contact part which is in contact with the male tab inserted into the housing part and a sidewall part which is provided at a periphery of the contact part, the contact part includes a reverse direction side top part protruding in reverse to a travel direction of the male tab when it is inserted into the housing part, the reverse direction side top part having a first pointed tip, and first and second cross side top parts respectively protruding in a direction crossing with the travel direction of the male tab in a plan view, and an internal angle of the first pointed tip is smaller than an angle between a first virtual line connecting the first pointed tip to a tip of the first cross side top part and a second virtual line connecting the first pointed tip to a tip of the second cross side top part.

8. The electrical connector according to claim 7, wherein the contact part further includes a travel direction side top part protruding in the same direction as the travel direction of the male tab when it is inserted into the housing part in the plan view, the travel direction side top part having a second pointed tip, and an internal angle of the second pointed tip is smaller than an angle between a first virtual line connecting the second pointed tip to a tip of the first cross side top part and a second virtual line connecting the second pointed tip to a tip of the second cross side top part.

9. The electrical connector according to claim 8, wherein an angle of the travel direction side top part is 30° or less in the plan view.

10. The electrical connector according to claim 8, wherein the peripheral edge shape of the contact part is a combination of plural lines.

11. The electrical connector according to claim 8, wherein the peripheral edge shape of the contact part is a curve.

12. The electrical connector according to claim 8, wherein the peripheral edge shape of the contact part is a combination of a curve and a line.

13. The electrical connector according to claim 7, wherein the peripheral edge shape of the contact part is a combination of plural lines.

14. The electrical connector according to claim 7, wherein the peripheral edge shape of the contact part is a curve.

15. The electrical connector according to claim 7, wherein the peripheral edge shape of the contact part is a combination of a curve and a line.

16. The electrical connector according to claim 7, wherein a contact between the male tab and the contact part is any one of a surface contact, a line contact, and a point contact.

17. The electrical connector according to claim 7, wherein the internal angle of the first pointed tip and an internal angle of each of the first and second cross side top parts are each 30° or less in the plan view.

18. A manufacturing method of an electrical connector forming the electrical connector according to claim 7, comprising:

forming the protrusion by the press work using a metal mold.

19. A manufacturing method of an electrical connector forming the electrical connector according to claim 7, comprising:

forming the protrusion by the plating.

* * * * *